US009746247B2

(12) United States Patent
Edwards et al.

(10) Patent No.: US 9,746,247 B2
(45) Date of Patent: Aug. 29, 2017

(54) MECHANISM FOR MITIGATING HIGH HEAT-FLUX CONDITIONS IN A THERMOSIPHON EVAPORATOR OR CONDENSER

(71) Applicant: Phononic Devices, Inc., Durham, NC (US)

(72) Inventors: Jesse W. Edwards, Wake Forest, NC (US); Robert B. Allen, Winston-Salem, NC (US); Daniel Swann, Cockeysville, MD (US)

(73) Assignee: Phononic Devices, Inc., Durham, NC (US)

( * ) Notice: Subject to any disclaimer, the term of this patent is extended or adjusted under 35 U.S.C. 154(b) by 0 days.

(21) Appl. No.: 14/610,554

(22) Filed: Jan. 30, 2015

(65) Prior Publication Data

US 2015/0211803 A1 Jul. 30, 2015

Related U.S. Application Data

(63) Continuation of application No. PCT/US2015/013260, filed on Jan. 28, 2015.

(Continued)

(51) Int. Cl.
*F28D 15/00* (2006.01)
*F28D 15/02* (2006.01)

(Continued)

(52) U.S. Cl.
CPC ..... *F28D 15/0266* (2013.01); *F28D 15/0275* (2013.01); *F28D 15/046* (2013.01); *F28F 13/003* (2013.01)

(58) Field of Classification Search
CPC .... F28D 15/0266; F28D 15/04; F28D 15/046; F28D 15/043

(Continued)

(56) References Cited

U.S. PATENT DOCUMENTS 3,741,289 A * 6/1973 Moore ..... F28D 15/06 165/104.24
4,003,427 A * 1/1977 Leinoff et al. ..... 165/104.26

(Continued)

FOREIGN PATENT DOCUMENTS

DE 202012101335 U1 8/2012
EP 0668479 A1 8/1995

(Continued)

OTHER PUBLICATIONS

Invitation to Pay Additional Fees for PCT/US2015/013260, mailed Mar. 31, 2015, 5 pages.

(Continued)

*Primary Examiner* — Len Tran
*Assistant Examiner* — Claire Rojohn, III
(74) *Attorney, Agent, or Firm* — Withrow & Terranova, PLLC

(57) ABSTRACT

The present disclosure relates to systems, devices, and methods that augment a thermosiphon system with a thermally conductive matrix material to increase the surface area to volume ratio for heat conduction at a predetermined region(s) of the thermosiphon system while minimizing capillary forces that are isolated to those region(s). The thermosiphon system has tubing including a condenser region, an evaporator region, and an adiabatic region (e.g., a region between the condenser and evaporator regions). The tubing can contain a heat transport medium and can provide passive two-phase transport of the heat transport medium between the condenser and evaporator regions according to thermosiphon principles. The system also includes a thermally conductive matrix material contained in the condenser region and/or the evaporator region but not in the adiabatic region, such that the thermally conductive matrix material (Continued)

increases a surface area for heat transfer in the condenser region and/or the evaporator region.

13 Claims, 10 Drawing Sheets

Related U.S. Application Data

(60) Provisional application No. 61/932,377, filed on Jan. 28, 2014.

(51) Int. Cl.
*F28F 13/00* (2006.01)
*F28D 15/04* (2006.01)

(58) Field of Classification Search
USPC ..... 165/104.21, 104.26, 104.33
See application file for complete search history.

(56) References Cited

U.S. PATENT DOCUMENTS 5,522,455 A * 6/1996 Brown ..... F28D 15/04 165/104.21
8,434,225 B2 * 5/2013 Mahefkey ..... F28D 15/046 165/104.21
8,550,150 B2 * 10/2013 Hou ..... F28D 15/0266 165/104.21
8,627,879 B2 * 1/2014 Rosenfeld ..... F28D 15/043 165/104.21
2004/0040691 A1 * 3/2004 Jacque ..... F28D 15/043 165/42
2005/0051305 A1 * 3/2005 Hsu ..... F28D 15/046 165/104.26
2005/0230085 A1 * 10/2005 Valenzuela ..... 165/104.26
2005/0280996 A1 * 12/2005 Erturk ..... F28D 15/043 361/700
2007/0084587 A1 * 4/2007 Huang et al. ..... 165/104.26
2008/0078530 A1 * 4/2008 Chang ..... F28D 15/043 165/104.26
2009/0084526 A1 * 4/2009 Chang ..... F28D 15/046 165/104.26
2010/0181048 A1 * 7/2010 Hwang ..... F28D 15/046 165/104.26
2011/0192575 A1 * 8/2011 Figus ..... 165/104.26
2011/0277967 A1 * 11/2011 Fried ..... F28D 15/0266 165/104.26
2012/0192574 A1 * 8/2012 Ghoshal ..... F25B 21/02 62/3.2
2012/0325440 A1 * 12/2012 Honmura et al. ..... 165/104.26
2013/0291557 A1 11/2013 Edwards et al.

FOREIGN PATENT DOCUMENTS

WO 02081996 A2 10/2002
WO 2006082194 A1 8/2006

OTHER PUBLICATIONS

International Search Report and Written Opinion for PCT/US2015/013260, mailed Jun. 8, 2015, 16 pages.
Written Opinion for International Patent Application No. PCT/US2015/013260, mailed Feb. 4, 2016, 6 pages.
International Preliminary Report on Patentability for International Patent Application No. PCT/US2015/013260, mailed May 6, 2016, 7 pages.

* cited by examiner

MECHANISM FOR MITIGATING HIGH HEAT-FLUX CONDITIONS IN A THERMOSIPHON EVAPORATOR OR CONDENSER

RELATED APPLICATIONS

This application is a continuation of PCT application serial number PCT/US15/13260, filed Jan. 28, 2015, which claims the benefit of provisional patent application Ser. No. 61/932,377, filed Jan. 28, 2014, the disclosures of which are hereby incorporated herein by reference in their entireties.

FIELD OF THE DISCLOSURE

This disclosure relates to achieving an increased heat transfer rate at a condenser region and/or evaporator region of a thermosiphon system while minimizing unfavorable conditions caused by an increased heat-flux.

BACKGROUND

A thermosiphon system uses a process of passive two-phase heat exchange that involves moving heat based on natural convection. Convection is the movement of fluid caused by heat. In particular, hotter fluid tends to rise compared to colder fluid because the hotter fluid is less dense than the colder fluid, which is influenced by gravity to sink. This physical effect results in a transfer of heat carried by the fluid without the need of a mechanical pump.

A thermosiphon system includes a pipe that contains the fluid (e.g., a high pressure refrigerant) used for heat exchange. The pipe provides passive two-phase transport of the fluid between a condenser region of the pipe and an evaporator region of the pipe. The evaporator region is physically located below the condenser region. Fluid in the condenser region condenses as it cools, and the condensed fluid flows from the condenser region to the evaporator region of the pipe due to gravitational and/or centripetal forces. In the evaporator region, the fluid is heated, which causes the fluid to evaporate. The evaporated fluid then flows from the evaporator region to the condenser region of the pipe via buoyancy forces. The fluid cycles through this two-phase process during heat exchange.

When using a thermosiphon system for two-phase passive heat transport, one problem that must be addressed is managing high heat-flux conditions in the evaporator region and/or in the condenser region of the pipe(s) forming the thermosiphon system. For example, increasing heat transfer in the condenser region (or likewise the evaporator region) of a pipe of a thermosiphon system without suffering the losses and/or $\Delta T$ increases (i.e., increase in temperature differential) imposed by the increasing heat-flux (amount of heat transferred per unit area per unit time) in the condenser region requires an increase in surface area in the condenser region (i.e., an increased surface area for heat transfer between the working fluid and the cooling mechanism, e.g., a thermoelectric cooler). Conventional solutions to this problem include using complicated heat exchangers or manifolds to increase the surface area for heat exchange. These solutions are generally cost-prohibitive. Moreover, the benefits of these solutions are further negated when using high pressure refrigerants because the walls of the container used for heat exchange must be thickened to safely contain the highly pressured refrigerant, which causes significant thermal conduction losses (i.e., impedes thermal conduction).

Accordingly, a need exists for mechanisms to achieve high heat transfer rates in a thermosiphon evaporator and/or condenser while mitigating the drawbacks caused by an increased heat-flux.

SUMMARY

The present disclosure relates to systems, devices, and methods that augment a thermosiphon system with a thermally conductive matrix material to increase the surface area to volume ratio for heat conduction at a predetermined portion(s) of the thermosiphon system while minimizing capillary forces and fluid entrainment that are isolated to the predetermined portion(s). Embodiments of a thermosiphon system are disclosed. In some embodiments, the thermosiphon system includes tubing comprising a condenser region, an evaporator region, and a region between the condenser region and the evaporator region, the tubing being operative to contain a heat transport medium and operative to provide passive two-phase transport of the heat transport medium between the condenser region and the evaporator region according to thermosiphon principles, and a thermally conductive matrix material contained in at least one of the condenser region and the evaporator region of the tubing but not in the region of the tubing between the condenser region and the evaporator region, such that the thermally conductive matrix material increases a surface area for heat transfer in the at least one of the condenser region and the evaporator region of the tubing. In this manner, the augmented thermosiphon system can increase heat transport without using complicated and expensive heat exchangers and/or manifolds, while mitigating unfavorable conditions normally caused by an increased heat-flux.

In some embodiments, the thermally conductive matrix material comprises at least one of a random and a semi-random matrix structure. In some embodiments, the thermally conductive matrix material comprises a non-random matrix structure. In some embodiments, the heat transport medium is a fluid.

In some embodiments, the thermally conductive matrix material is contained in at least one of a portion of the condenser region and a portion of the evaporator region of the tubing. In some embodiments, the thermally conductive matrix material is contained in at least one of a region coextensive with the condenser region and a region coextensive with the evaporator region of the tubing.

In some embodiments, the thermally conductive matrix material comprises a mesh of a plurality of fibers, the plurality of fibers comprising at least one of randomized diameters, randomized lengths, and randomized spatial orientations. In some embodiments, the mesh comprises a porosity that is predetermined to minimize capillary forces while achieving a predetermined heat transfer rate based on an increased surface area provided by the mesh. In some embodiments, the mesh is deformable.

In some embodiments, the thermally conductive matrix material comprises at least one of thermally conductive fibers and thermally conductive particles. In some embodiments, the at least one of the thermally conductive fibers and the thermally conductive particles are comprised of at least one of a group consisting of copper and aluminum.

In some embodiments, the thermally conductive matrix material is a sintered powder. In some embodiments, the sintered powder comprises a density that is predetermined to minimize capillary forces while achieving a predetermined heat transfer rate based on an increased surface area provided by the sintered powder.

In some embodiments, the thermally conductive matrix material comprises an arrangement of a plurality of prefabricated screens. In some embodiments, the arrangement comprises a predetermined number of the plurality of prefabricated screens. In some embodiments, the predetermined number of the plurality of prefabricated screens is determined to minimize capillary forces while achieving a predetermined heat transfer rate based on an increased surface area provided by the plurality of prefabricated screens. In some embodiments, the arrangement of the plurality of prefabricated screens is stacked in randomized orientations.

In some embodiments, a structure formed by the thermally conductive matrix material when contained in the at least one of the condenser region and the evaporator region of the tubing is a porous structure. In some embodiments, the thermally conductive matrix material has a helical ribbon geometry.

In some embodiments, a thermal conductivity of the thermally conductive matrix material is equal to or greater than a thermal conductivity of the tubing.

In some embodiments, the thermally conductive matrix material is contained in the condenser region. In some embodiments, the thermally conductive matrix material is contained in the evaporator region. In some embodiments, the thermally conductive matrix material is contained in the condenser region and contained in the evaporator region.

Embodiments of a tubing for a thermosiphon system are also disclosed. In some embodiments, the tubing for the thermosiphon system includes a thermally conductive matrix material that increases a surface area for heat transfer in at least one of a condenser region of the tubing and an evaporator region of the tubing but not in a region of the tubing between the condenser region and the evaporator region, the tubing being operative to contain a heat transport medium and being operative to provide passive two-phase transport of the heat transport medium between the condenser region and the evaporator region according to thermosiphon principles.

In some embodiments, the thermally conductive matrix material comprises a porosity that is predetermined to minimize capillary forces while achieving a predetermined heat transfer rate based on an increased surface area provided by the thermally conductive matrix material.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 1:
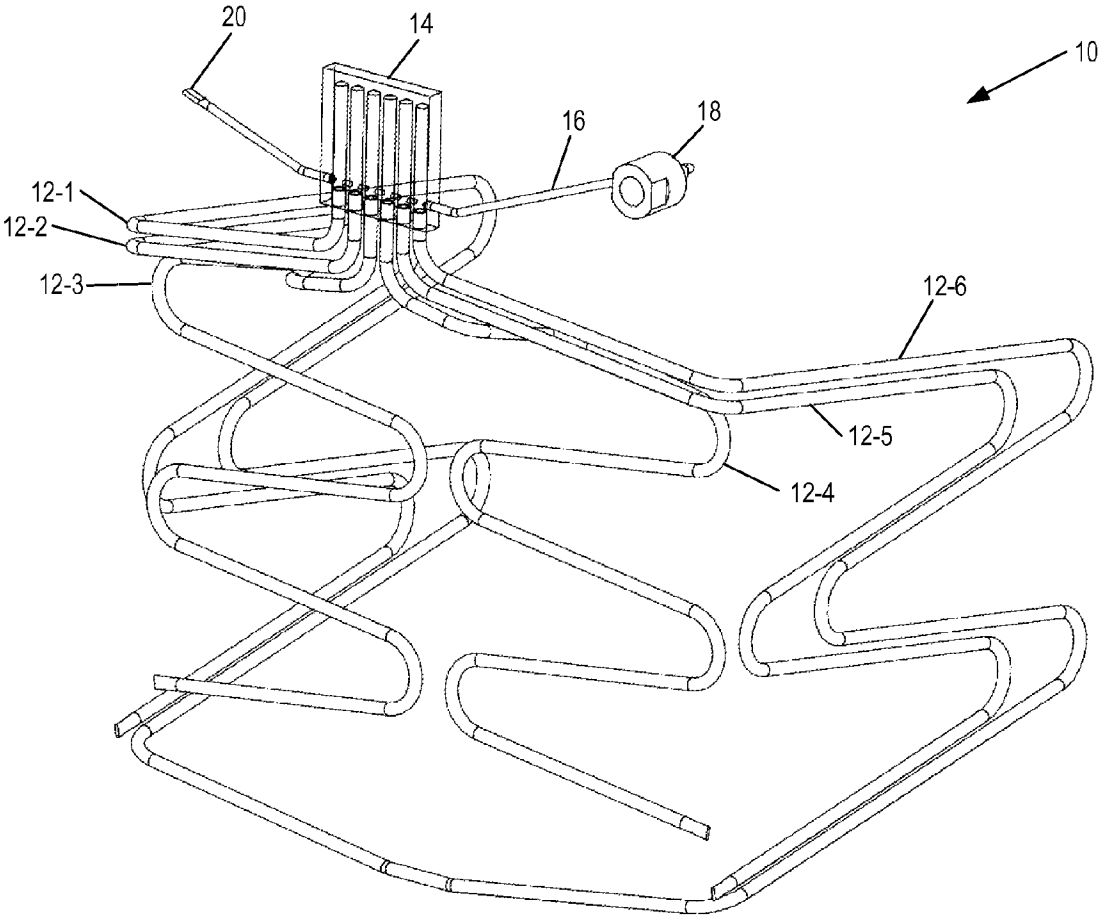
FIG. 1 illustrates a thermosiphon system that includes transport tubes coupled to a heat exchange block according to some embodiments of the present disclosure.
Figure 8:
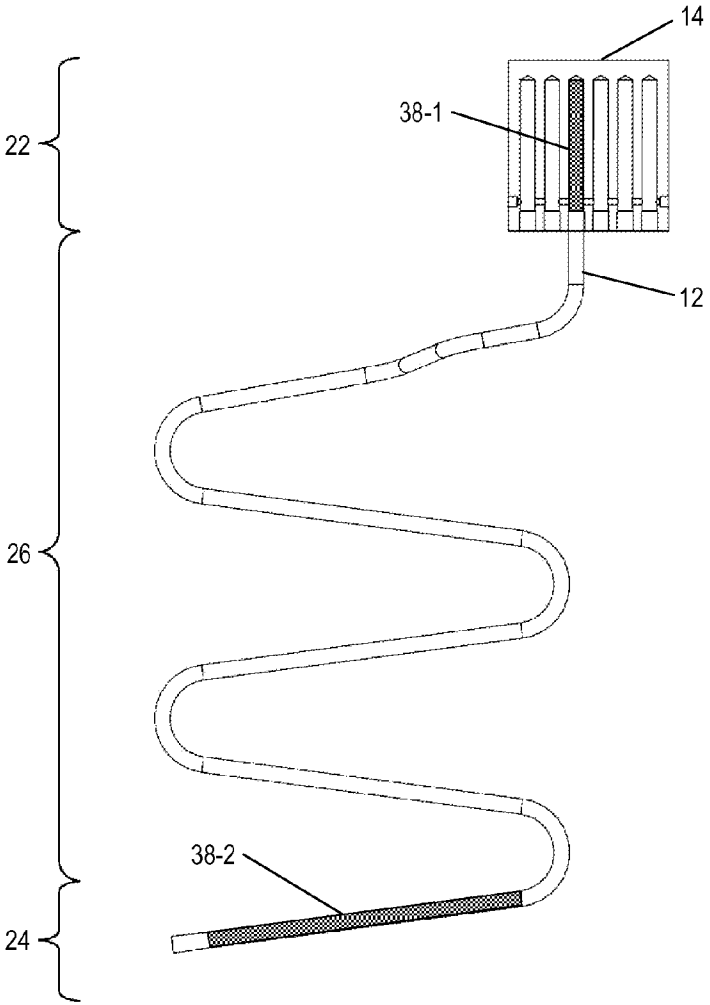
Figure 9:
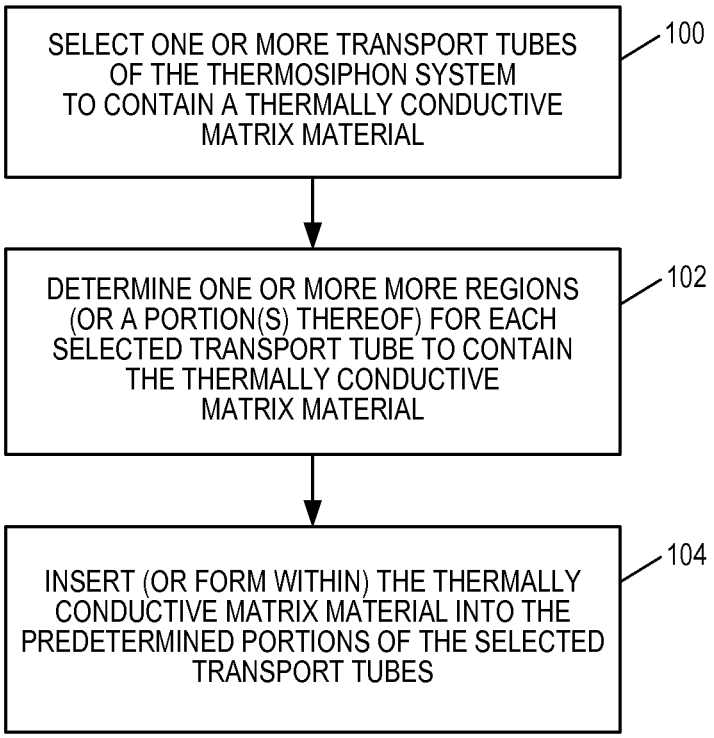

FIG. 8 illustrates one single tube and the heat exchange block of the thermosiphon system from FIG. 1 in which a thermally conductive matrix material is contained in both the evaporator region and the condenser region of the same tube of the thermosiphon system according to some embodiments of the present disclosure; and FIG. 9 is a flowchart showing a method for augmenting a thermosiphon system according to some embodiments of the present disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It should also be understood that although the terms "first," "second," etc., may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and "including" when used herein to specify the presence of stated features, steps, operations, elements, and/or components, do not preclude the presence or addition of one or more other features, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art, and will not be interpreted in an idealized or overly formal sense unless expressly so defined herein.

The present disclosure relates to systems, devices, and methods that augment a thermosiphon system with a thermally conductive matrix material to increase the surface area to volume ratio for heat conduction at a predetermined portion(s) of the thermosiphon system while minimizing capillary forces and fluid entrainment that are isolated to the predetermined portion(s). Embodiments of a thermosiphon system are disclosed. In some embodiments, the thermosiphon system includes tubing comprising a condenser region, an evaporator region, and a region between the condenser region and the evaporator region, the tubing being operative to contain a heat transport medium and operative to provide passive two-phase transport of the heat transport medium between the condenser region and the evaporator region according to thermosiphon principles, and a thermally conductive matrix material contained in at least one of the condenser region and the evaporator region of the tubing but not in the region of the tubing between the condenser region and the evaporator region, such that the thermally conductive matrix material increases a surface area for heat transfer in the at least one of the condenser region and the evaporator region of the tubing. In this manner, the augmented thermosiphon system can increase heat transport without using complicated and expensive heat exchangers and manifolds, while mitigating unfavorable conditions normally caused by an increased heat-flux.

A brief discussion of a thermosiphon system contained in a heat transport apparatus is provided for context and to aid in understanding of the disclosure, without limiting the thermosiphon system for use in any specific heat transport apparatus. For example, a thermosiphon system may be included in a heat transport apparatus such as the thermoelectric refrigerator disclosed in commonly owned and assigned U.S. Patent Application Publication No. 2013/0291557, entitled THERMOELECTRIC REFRIGERATION SYSTEM CONTROL SCHEME FOR HIGH EFFICIENCY PERFORMANCE, which is hereby incorporated by reference in its entirety.

The thermoelectric refrigeration system may include a thermosiphon system operative to decrease the temperature of a cooling chamber coupled to the thermosiphon system. The thermosiphon system may include a cold side heat exchanger that absorbs heat from the cooling chamber and a hot side heat exchanger to expel heat from the thermoelectric refrigeration system to an external environment, which may each include a thermosiphon. This process of absorbing heat from a cooling chamber and expelling it to an external environment cycles as necessary to decrease the temperature of the cooling chamber. For simplicity, a single thermosiphon for the thermoelectric refrigeration system is discussed below in connection with the figures.

FIG. 1 illustrates a thermosiphon system 10 that includes multiple transport tubes 12-1 through 12-6 (generally referred to herein collectively as transport tubes 12 and individually as transport tube 12) in which an evaporator region and/or a condenser region of at least one, and possibly all, of the transport tubes 12 are augmented with a thermally conductive matrix material according to some embodiments of the present disclosure. A thermally conductive matrix material, as referred to herein, is a thermally conductive material that provides a porous structure when contained in at least a portion of the condenser region and/or an evaporator region of the transport tube(s) 12 and increases the surface area for heat transfer between the heat transport medium within the condenser region and/or the evaporator region of the transport tube(s) 12 and that which is external to the condenser region and/or the evaporator region of the transport tube(s) 12, as further detailed below. The thermally conductive matrix material may be formed of a thermally conductive material including one or more combinations of aluminum, copper, stainless steel, or any thermally conductive material. In some embodiments, the thermal conductivity of the thermally conductive matrix material is equal to or greater than the thermal conductivity of the transport tubes 12 that contain the thermally conductive matrix material.

As discussed below, the thermally conductive matrix material increases the surface area for heat transfer in the evaporator region and/or the condenser region of the transport tube(s) 12, thereby improving heat transfer while managing heat-flux. This can be done without the need for complicated or expensive manifolds, as is conventionally done. The thermosiphon system 10 may be used in any suitable application in which heat transfer is desired. For instance, the thermosiphon system 10 of FIG. 1 may be used in, for example, the thermoelectric refrigerator disclosed in commonly owned and assigned U.S. Patent Application Publication No. 2013/0291557 indicated above. However, the thermosiphon system 10 is not limited thereto. Further, the particular arrangement of the thermosiphon system 10 illustrated in FIG. 1 is only an example. The concepts discussed herein are equally applicable to any thermosiphon system containing one or more transport tubes 12.

The transport tubes 12 of the thermosiphon system 10 of FIG. 1 are coupled to a heat exchange block 14. The transport tubes 12 may include several transport tubes of variable or uniform lengths, diameters, shapes, and designs. Each transport tube 12 is arranged for two-phase passive transport of a heat transport medium and embodies a thermosiphon. When implemented in a refrigerator, the transport tubes 12 may be arranged along sides and a rear wall of a cooling chamber of the refrigerator, for example. As shown, each transport tube 12 is coupled to the heat exchange block 14 at one end and terminates at another end or connects to another transport tube 12 to form a loop. The transport tubes 12 may be formed of any combinations of one or more thermally conductive materials such as aluminum, copper, stainless steel, or any other thermally conductive material.

In this example, an interconnect line 16 is coupled to the heat exchange block 14 and is terminated at opposing ends by fittings 18 and 20 to permit a heat transport medium to be added to, or removed from, the transport tubes 12. The heat transport medium may be any substance or combination of substances that can transport heat according to thermosiphon principles. In some embodiments, the heat transport medium is a fluid (sometimes referred to herein as a working fluid) that changes between two phases (e.g., a two-phase coolant). Examples of phases include gas, liquid, or plasma.

Figure 2:
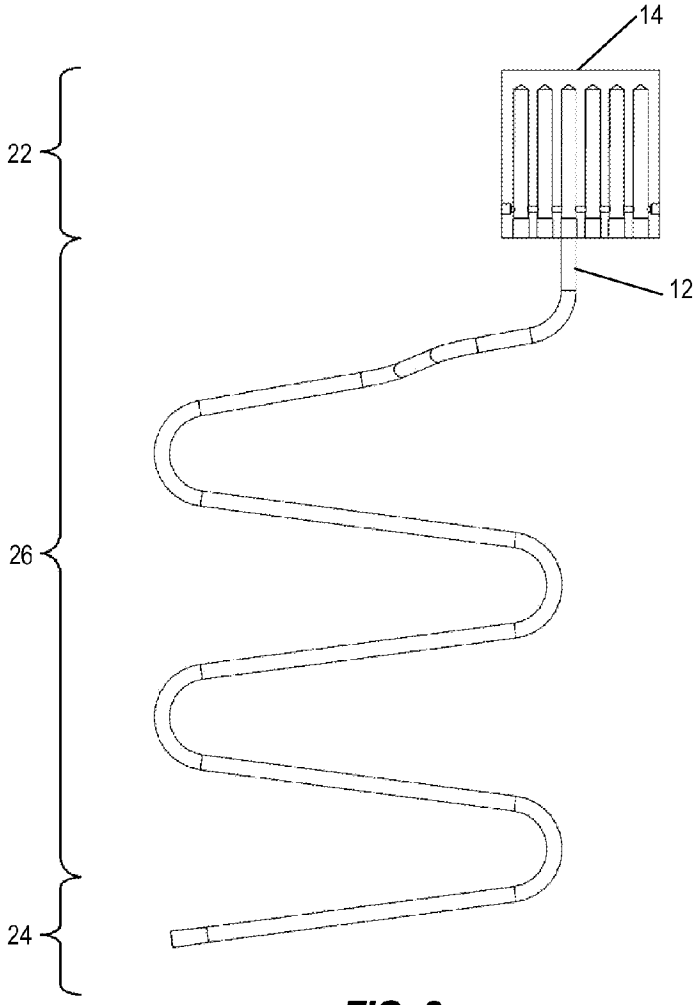
FIG. 2 illustrates regions of a single transfer tube and heat exchange block of the thermosiphon system from FIG. 1 according to embodiments of the present disclosure.

FIG. 2 is a simplified illustration of the thermosiphon system 10 of FIG. 1 in which only one of the transport tubes 12 is illustrated for clarity and ease of discussion. As indicated above, the transport tube 12 embodies a thermosiphon. Accordingly, FIG. 2 shows a single thermosiphon of the thermosiphon system 10 from FIG. 1 merely to aid in understanding, but its features are applicable to any and every transport tube 12 shown in FIG. 1. As shown in FIG. 2, the transport tube 12 includes a condenser region 22 located above (relative to the ground) an evaporator region 24, and an adiabatic region 26 between the condenser region 22 and the evaporator region 24. The adiabatic region 26 may also be referred to as an antipodal region. An adiabatic region 26, as referred to herein, is a region of a transport tube 12 that does not transfer heat between the heat transport medium in the transport tube 12 and its surroundings (or transfers a negligible amount of heat).

As discussed below, the condenser region 22 and/or the evaporator region 24, but not the adiabatic region 26, of the transport tube 12 contains a thermally conductive matrix material that increases the surface area within the condenser region 22 and/or the evaporator region 24 for heat transfer between the heat transport medium (e.g., working fluid) and the environment exterior to the condenser region 22 and/or the evaporator region 24. The separation of the condenser region 22 and the evaporator region 24 by the adiabatic region 26 maintains a thermal diode effect for the transport tube 12, particularly where the thermally conductive matrix material is contained in both the condenser region 22 and the evaporator region 24. In particular, due to its principles of operation, a thermosiphon provides heat transfer in a single direction. In other words, a thermosiphon operates as a thermal diode. As discussed below, adding the thermally conductive matrix material to the condenser region 22 and/or the evaporator region 24 results in capillary forces in the condenser region 22 and/or the evaporator region 24 that can provide at least some bi-directional heat transport (i.e., the condenser region 22 and/or the evaporator region 24 operate, at least somewhat, like a heat pipe, which provides bi-directional heat transfer, due to the inclusion of the thermally conductive matrix material). By not including any thermally conductive matrix material in the adiabatic region 26, the adiabatic region 26 operates according to thermosiphon principles (i.e., operates as a true thermosiphon) and thereby provides heat transport in only one direction (i.e., acts as a thermal diode). Accordingly, the adiabatic region 26 maintains a thermal diode effect for the transport tube 12.

The condenser region 22, the evaporator region 24, and the adiabatic region 26 are not limited to the areas shown in FIG. 2. Instead, the regions designated in FIG. 2 are meant to aid in understanding by showing the relative position of each region with respect to the other regions. The regions may not have a specific fixed boundary along a transport tube 12 and can vary depending on a particular implementation.

In practice, the heat transport medium is heated in the evaporator region 24 (e.g., via conduction between the heat transport medium contained in the transport tube 12 and the environment external to the evaporator region 24 of the transport tube 12). The evaporated heat transport medium travels from the evaporator region 24 through the adiabatic region 26 to the condenser region 22 via buoyancy forces. In the condenser region 22, the heat transport medium is cooled and the resulting condensed heat transport medium travels back to the evaporator region 24 through the adiabatic region 26 due to gravitational and/or centripetal forces. The process repeats in this manner in accordance with thermosiphon principles as long as, in this example, the condenser region 22 is cooled to a temperature that is less than the temperature of the evaporator region 24 (e.g., as long as a thermoelectric cooler(s) that operate to cool the condenser region 22 of the transport tube 12 via the heat transport block 14 is (are) active).

As indicated above, when using thermosiphon systems for passive heat exchange it is often difficult to manage high heat-flux conditions at the condenser region 22 and/or the evaporator region 24. For example, increasing heat transfer in the condenser regions 22 of the transport tubes 12 (e.g., by increasing current to a thermoelectric cooler(s) used to cool the condenser regions 22 of the transport tubes 12) results in increased heat-flux in the condenser regions 22. To achieve increased heat transfer while managing heat-flux in the condenser regions 22, it is desirable to increase the surface area for heat transfer in the condenser regions 22. Conventionally, increasing the surface area for heat transfer is accomplished using complicated and expensive heat exchangers and manifolds. These solutions are both cost-prohibitive and undesirable because of their complexity. As such, the inability to effectively manage high heat-flux conditions is often ignored and any associated costs are considered necessary for using passive heat exchange systems. Moreover, the benefits of conventional solutions are further negated when using high pressure refrigerants because the walls of the transport tubing used for heat exchange must be thickened to safely contain the refrigerant, which impedes thermal conduction.

Embodiments disclosed herein provide solutions to the aforementioned problems by enabling management of high heat-flux conditions in the condenser region 22 and/or the evaporator region 24 of the transport tubes 12 in the thermosiphon system 10 by providing significantly increased surface area to volume ratios inside the transport tubes 12 through the addition of a highly (thermally) conductive matrix of, for example, random or semi-random particles or fibers such as a copper or aluminum mesh, or sintered powders. This random or semi-random matrix augments the thermosiphon system 10 in either or both the localized condenser regions 22 or the localized evaporator regions 24 of the transport tubes 12 of the thermosiphon system 10 but not in the inactive or unenhanced region of the thermosiphon system 10 (i.e., the adiabatic region 26 between the condenser regions 22 and the evaporator regions 24 of the transport tubes 12). The location of the random or semi-random thermally conductive matrix material may depend on a desired application for heat absorption or heat rejection. For example, the thermally conductive matrix material may be contained in the transport tubes 12 of the heat exchange block 14 located in the condenser region 22 of the thermosiphon system 10.

Figure 3A:
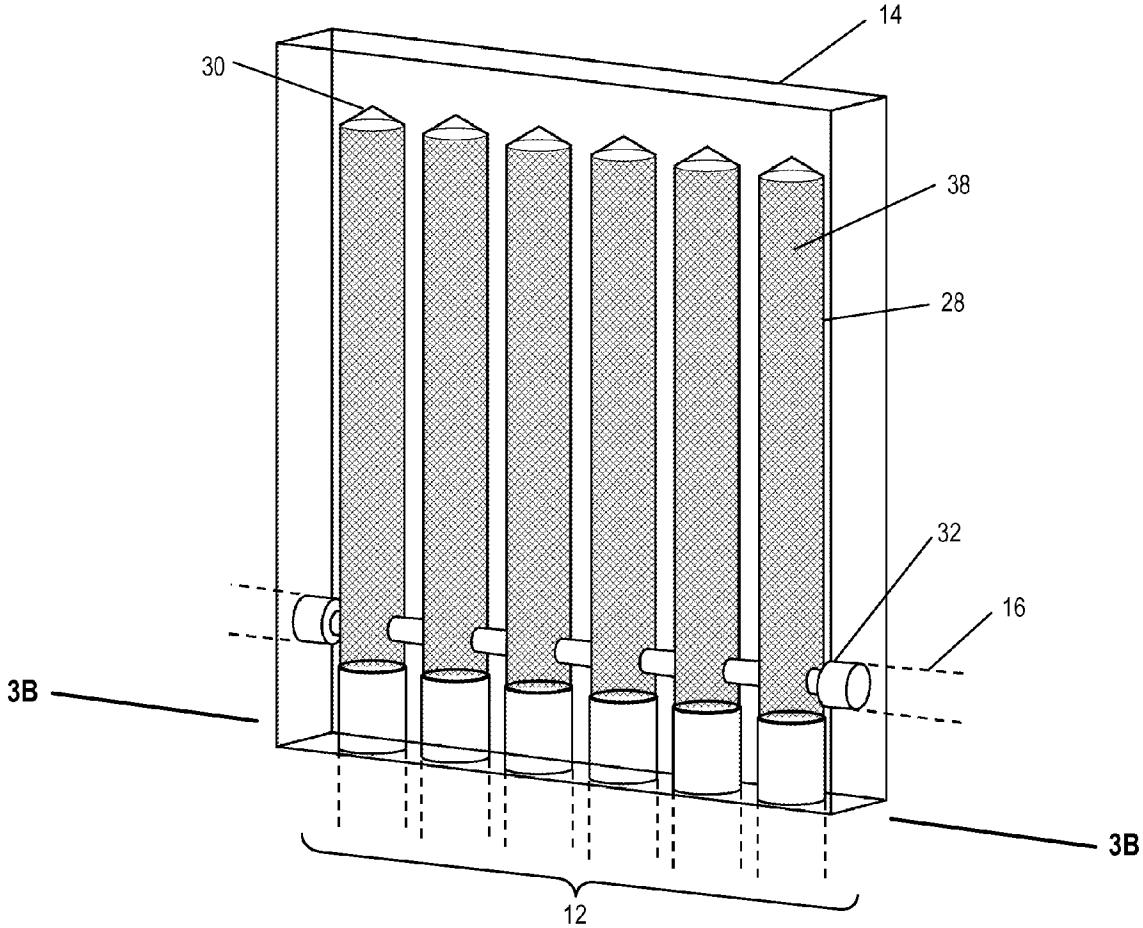
FIG. 3A illustrates the heat exchange block from FIG. 1 in which the condenser regions of the tubes in the thermosiphon system have been augmented with thermally conductive matrix material according to some embodiments of the present disclosure.

FIG. 3A illustrates the heat exchange block 14 from FIGS. 1 and 2 in which the condenser regions 22 of the transport tubes 12 have been augmented with thermally conductive matrix material according to some embodiments of the present disclosure. In some embodiments, the heat exchange block 14 may be formed of a thermally conductive material including one or more combinations of aluminum, copper, stainless steel, or any thermally conductive material. The heat exchange block 14 and the transport tubes 12 may be formed of the same or different material. In some embodiments, the heat exchange block 14 is formed of a material that provides at least the same amount of thermal conductivity as the transport tubes 12 to maintain effective thermal conductance by the thermosiphon system 10.

As shown in FIG. 3A, the heat exchange block 14 includes six longitudinal fluid ports 28 that may be formed by drilling into a block of material or by using other suitable cavity forming means, yielding a crowned portion at a terminus 30 of each longitudinal fluid port 28. Respective ends of the six transport tubes 12 are received by the six longitudinal fluid ports 28 such that the fluid ports 28 form part of the transport tubes 12 located within the heat exchange block 14. Accordingly, the transport tubes 12 of the thermosiphon system 10 are said to include the respective fluid ports 28 of the heat exchange block 14. On the opposing side of the termini 30, an interconnect port 32 extends laterally through the longitudinal fluid ports 28, and may be formed by drilling or other suitable cavity forming means. The interconnect line 16 is coupled to the interconnect port 32 and is terminated at opposing ends by the fittings 18 and 20 (not shown) that permit heat transport fluid to be added to (or removed from) the transport tubes 12.

FIG. 3A further shows a thermally conductive matrix material 38 contained in the fluid ports 28 of the heat exchange block 14 according to some embodiments of the present disclosure. As discussed above, the fluid ports 28 form part of the corresponding transport tubes 12 and, more specifically, correspond to the condenser regions 22 of the transport tubes 12.

Figure 3B:
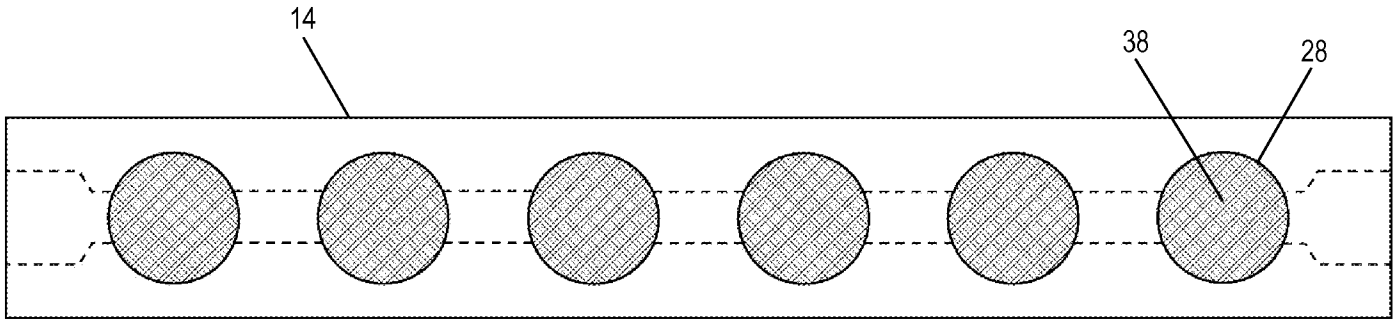
FIG. 3B illustrates an end view of the heat exchange block from FIG. 3A showing the thermally conductive matrix material within the condenser regions of the tubes in the thermosiphon system according to embodiments of the present disclosure.

FIG. 3B shows an end view of the heat exchange block 14 of FIG. 3A showing the thermally conductive matrix material 38 within the fluid ports 28 (i.e., within the condenser regions 22 of the transport tubes 12). It should be understood that FIGS. 3A and 3B show an embodiment that is meant to provide context and to aid understanding of the disclosure, without limiting the characteristics of the thermally conductive matrix material 38 or its location in the transport tubes 12.

The thermally conductive matrix material 38 may be contained in various locations within any one or more of the transport tubes 12. In particular, the thermally conductive matrix material 38 may be located in a portion of or the entire condenser region 22 of the transport tubes 12 (i.e., a portion/region coextensive with the condenser region 22) or in a portion of or the entire evaporator region 24 of the transport tubes 12 (i.e., a portion/region coextensive with the evaporator region 24), as further detailed below. For example, the thermally conductive matrix material 38 may be contained in the entire condenser region 22 of any one or more, and potentially all, of the transport tubes 12 or contained in only a portion of or multiple different portions of the condenser region 22 of any one or more, and potentially all, of the transport tubes 12. In the same manner, as discussed below, the thermally conductive matrix material 38 may be contained in the evaporator regions 24 of any one or more, and potentially all, of the transport tubes 12.

The thermally conductive matrix material 38 is a thermally conductive porous material that increases the surface area within, in the example of FIGS. 3A and 3B, the condenser region(s) 22 of the transport tube(s) 12. In some embodiments, the thermal conductivity of the thermally conductive matrix material 38 is greater than or equal to that of the material used for the transport tubes 12. A heat transfer rate (Q) in the condenser regions 22 of the transport tubes 12 can be defined as $Q=k*A*\Delta T$, where k is a thermal conductivity of the material used for the thermally conductive matrix material 38, A is a surface area for heat transport, and $\Delta T$ is a temperature difference between the heat transport medium within the condenser regions 22 of the transport tubes 12 and the temperature of the condenser regions 22 of the transport tubes 12. Thus, by including the thermally conductive matrix material 38 in the condenser region(s) 22 of the transport tube(s) 12, the surface area (A) for heat transport is increased, which, all else being equal, increases the heat transfer rate (Q). In addition, the volume of the condenser region(s) 22 of the transport tube(s) 12 that contain the thermally conductive matrix material 38 can remain the same while increasing the heat transfer rate (Q). Still further, heat-flux is managed in the sense that the heat-flux does not need to increase the system $\Delta T$ to provide the increased heat transfer rate (Q) and, as such, problems associated with a high heat-flux can be mitigated.

In some embodiments, porosity of the thermally conductive matrix material 38 is such that the desired surface area is provided while also managing capillary forces caused by the thermally conductive matrix material 38. Capillary forces created by the thermally conductive matrix material 38, if not managed, may result in a number of problems including undesirable bi-directional heat transport within the condenser region 22 and/or the evaporator region 24 of the transport tube(s) 12 containing the thermally conductive matrix material 38 and decreased flow rate of the heat transport medium due to collection of the heat transport medium within the thermally conductive matrix material 38. These problems are isolated to the condenser region 22 and/or the evaporator region 24 containing the thermally conductive matrix material 38, but may be undesirable nonetheless. The capillary forces resulting from the thermally conductive matrix material 38 are directly related to the porosity of the thermally conductive matrix material 38. As the porosity of the thermally conductive matrix material 38 decreases (and thus the surface area for heat transport increases), capillary forces increase. Therefore, in some embodiments, the porosity of the thermally conductive matrix material 38 is such that: (a) a desired heat transfer rate (Q) is achieved for some particular implementation of the thermosiphon system 10 (i.e., some predefined set of parameters including k, $\Delta T$, dimensions of the condenser region 22 and the evaporator region 24 containing the thermally conductive matrix material 38, material used as the thermally conductive matrix material 38, etc.) and (b) capillary forces resulting from the thermally conductive matrix material 38 are minimized for the desired heat transfer rate (Q) given the particular implementation of the thermosiphon system 10 or at least are less than some predefined maximum acceptable value).

In some embodiments, the thermally conductive matrix material 38 is a random, semi-random, and/or non-random structure. The thermally conductive matrix material 38 may comprise any one or more combinations of particles, fibers, or the like. For example, the thermally conductive matrix material 38 may comprise a sintered powder, a mesh of fibers, or a combination of both. The sintered powder or mesh of fibers may be rigid or deformable. For example, the mesh of fibers may be steel wool or some material having the structure and density of steel wool but made of a material other than steel (e.g., copper).

A random structure of the thermally conductive matrix material 38 refers to a structure in which all structural characteristics vary randomly or at least pseudo-randomly (i.e., vary in accordance with an unsystematic, nonspecific, or chaotic process). For example, in some embodiments, the thermally conductive matrix material 38 is a mesh of fibers having a random structure in that the length and diameter of the fibers as well as the arrangement of the fibers in the mesh are all random or at least pseudo-random. In contrast, a semi-random structure of the thermally conductive matrix material 38 refers to a structure in which one or more but not all of the structural characteristics of the structure vary randomly. For example, in some embodiments, the thermally conductive matrix material 38 is a mesh of fibers having a semi-random structure in that the length and diameter of all the fibers are the same but the arrangement of the fibers is random or at least pseudo-random. Randomized characteristics of particles may include size and shape. Randomized characteristics of fibers may include diameter, length, and spatial orientation.

Figure 4:
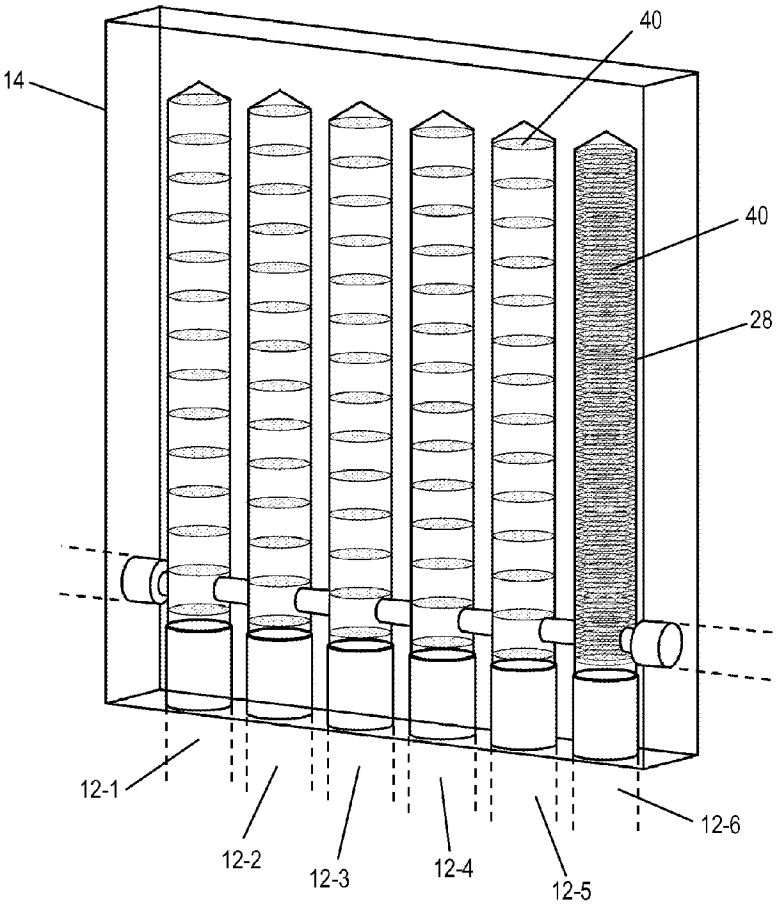
FIG. 4 illustrates an embodiment in which the thermally conductive matrix material of FIGS. 3A and 3B comprises a stack of prefabricated screens according to embodiments of the present disclosure.

In some embodiments, the thermally conductive matrix material 38 may be a stack of prefabricated screens. In this regard, FIG. 4 illustrates embodiments in which the thermally conductive matrix material 38 is formed by a stack of prefabricated screens 40 that are stacked in the condenser regions 22 of the transport tubes 12 according to embodiments of the present disclosure. The stacked screens 40 may have various and different geometries and may be contained within the transport tube 12 along various and different spatial orientations. As shown, the screens 40 are stacked along the length of the condenser regions of any transport tubes 12-1 through 12-5 in accordance with a first predetermined spacing, and stacked along the length of the condenser region of the transport tube 12-6 in accordance with a second predetermined spacing. The second predetermined spacing being less than the first predetermined spacing. In other words, the number of screens 40 in the condenser region of the transport tube 12-6 is greater than the number of screens 40 in the condenser region of each of the other transport tubes 12-1 through 12-5. In this manner, the surface area enhancement as well as the porosity of the thermally conductive matrix material 38 can be controlled. Also, as discussed above, not all of the transport tubes 12 necessarily contain the thermally conductive matrix material 38, which is formed by the screens 40 in this embodiment.

The screens 40 may have random, semi-random, and/or non-random structural characteristics. Examples of structural characteristics include the shape and size of a screen, the relative spatial orientations of stacked screens, the mesh density of screens, and the like. For example, a random structure for the thermally conductive matrix material 38 may include a stack of screens 40 with various and different spatial orientations that were determined according to a random process. In contrast, as an example, a semi-random structure for the thermally conductive matrix material 38 may include a stack of screens 40 having random orientations along a first axis, but their orientations along a second axis are not random. For example, the screens 40 may be randomly rotated (i.e., first axis) but equally spaced in parallel along the length of the transport tubes 12 (i.e., second axis). A non-random structure for the thermally conductive matrix material 38 may include a stack of screens 40 without random structural characteristics.

Figure 5:
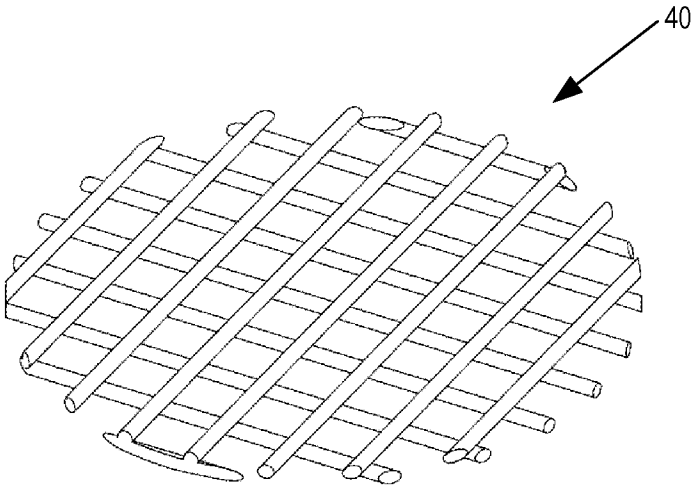
FIG. 5 illustrates one of the prefabricated screens of FIG. 4 according to some embodiments of the present disclosure.

FIG. 5 illustrates a single prefabricated screen 40 according to some embodiments of the present disclosure. As shown, the screen 40 is shaped to be contained inside of the transport tube 12 and is formed of thermally conductive mesh material. A geometric design of the prefabricated screen 40 may be optimized to further improve function as a low restriction conduit or pathway. Each prefabricated screen 40 may have a geometric design to ease the supply or return of the heat transport medium that passes through the stacked screens 40 contained in the transport tube 12. In some embodiments, the screen 40 may include an area with a mesh material and an area without a mesh material. For example, the screen 40 may be formed in the shape of an annulus without any mesh material in the center of the screen 40.

The number of screens 40 stacked within the condenser region(s) 22 of the transport tube(s) 12 can be selected to achieve a desired surface area to volume ratio. For example, referring back to FIG. 4, the condenser regions 22 of the transport tubes 12-1 through 12-5 each include a first number of stacked screens 40 per unit volume, and the condenser region 22 of the transport tube 12-6 includes a second number of stacked screens 40 per unit volume. As shown, the second number of stacked screens 40 per unit volume of the transport tube 12-6 is greater than the first number of stacked screens 40 per unit volume in any of the transport tubes 12-1 through 12-5. Accordingly, the surface area to volume ratio for the transport tube 12-6 is greater than the surface area to volume ratio for any of transport tubes 12-1 through 12-5.

The increase in the surface area to volume ratio can be calculated based on the number of screens 40 and the surface area of each screen 40. Further, the number of stacked screens 40 may be predetermined to optimize the surface area to volume ratio while maintaining porosity necessary to provide a low restriction conduit or pathway for the heat transport medium. Accordingly, the number of screens 40 per unit volume defines the surface area added to the thermosiphon system 10, as well as the porosity of the stacked screens 40 by simply varying the number of screens 40 in a working volume. In this way the balance between increased surface area and capillary force can be controlled. Thus, stackable screens 40 can be used at the evaporator region 24 and/or the condenser region 22 to provide a high heat transfer region that promotes evaporation or condensation, respectively, while minimizing wicking caused by capillary forces.

Figure 6:
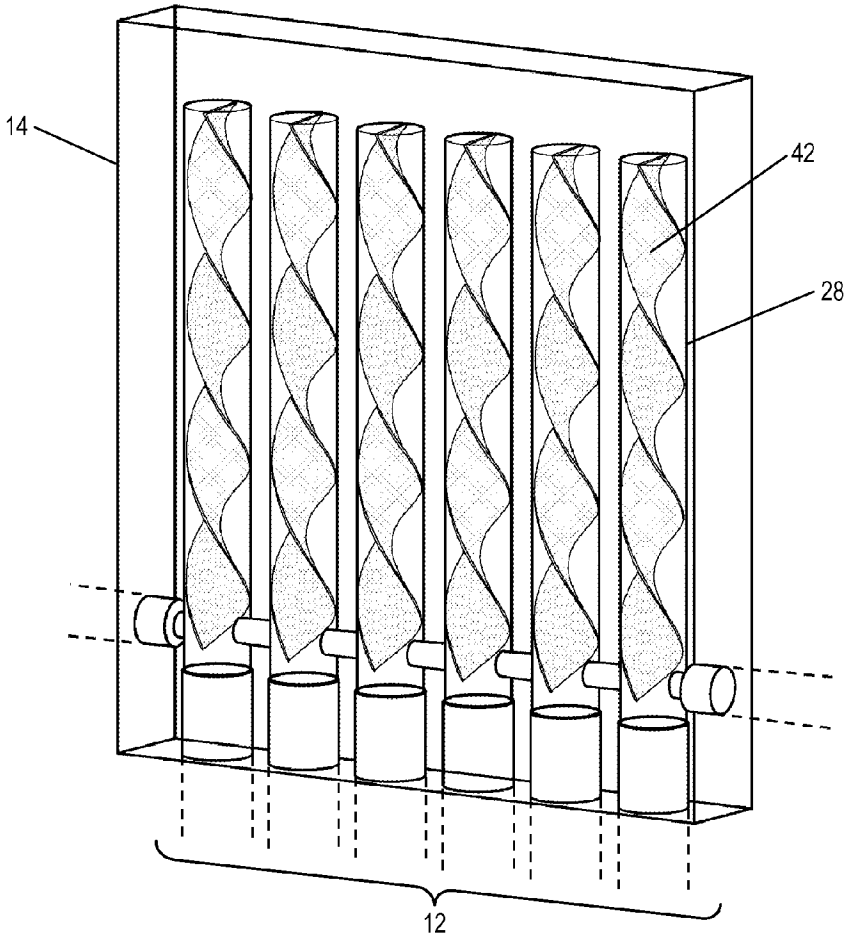
FIG. 6 illustrates an embodiment in which the thermally conductive matrix material of FIGS. 3A and 3B is a helical ribbon according to embodiments of the present disclosure.

Prefabricated thermally conductive matrix material is not limited to stackable screens. FIG. 6 illustrates an embodiment of the thermally conductive matrix material 38 in which the thermally conductive matrix material 38 is a helical ribbon 42 contained in the condenser regions 22 of the transport tubes 12 according to embodiments of the present disclosure. As shown, the helical ribbons 42 augment the surface area to volume ratios of the condenser regions 22 of the transport tubes 12. The helical ribbons 42 are thermally conductive. The geometric shape of the helical ribbons 42, when contained in the transport tubes 12, provides porous structures. Accordingly, the material that forms the helical ribbon 42 may be formed of a porous or non-porous material and still provides a porous structure when contained in the transport tubes 12. This allows the heat transport medium to flow through the augmented tubes while minimizing capillary forces and fluid entrainment because the overall geometric structure of the helical ribbon 42, when contained in transport tubes 12, form porous structures. In some embodiments, the helical ribbons 42 may be formed of a porous material to further enhance the surface area to volume ratio of the augmented transport tube 12 and further minimize any wicking cause by capillary forces.

The location of thermally conductive matrix material 38 is not limited to the condenser regions 22 of the transport tubes 12. More specifically, the thermally conductive matrix material 38 may be contained in the condenser regions 22 of any one or more of the transport tubes 12 and/or contained in the evaporator regions 24 of any one or more of the transport tubes 12. The thermally conductive matrix material 38 is generally contained in at least one of the condenser region 22 and the evaporator region 24 of at least one of the transport tubes 12, and not contained in the adiabatic region 26 of the transport tubes 12. Limiting the location of the thermally conductive matrix material 38 to portions of the transport tube 12 that exclude the adiabatic region 26 is desired because this maintains the thermal diode effect of the transport tubes 12 (i.e., heat can still only be transported in one direction).

Figure 7:
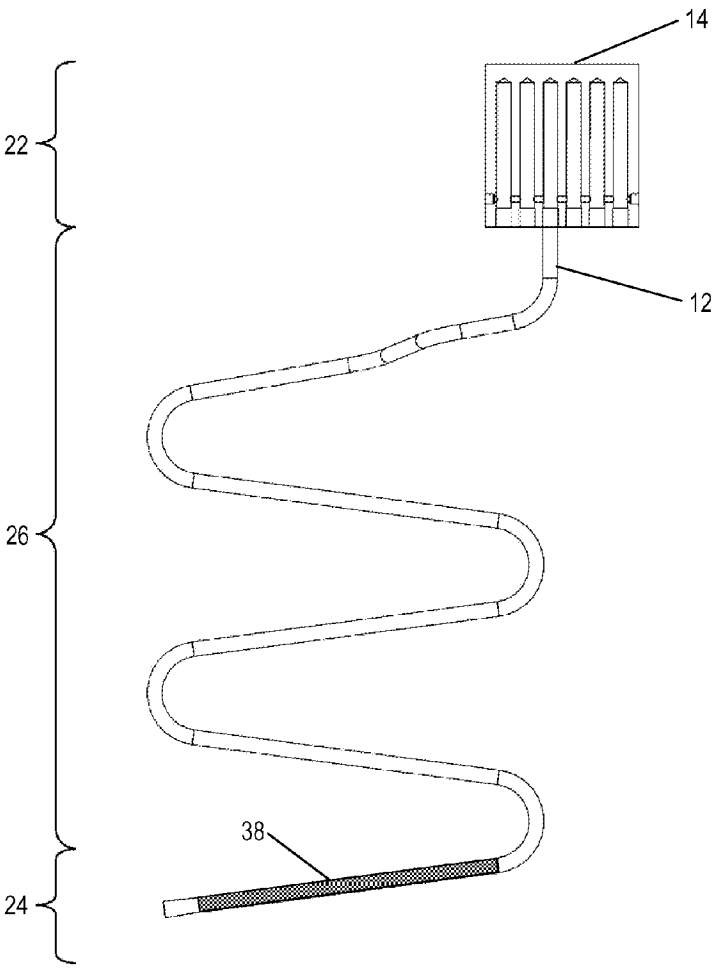
FIG. 7 illustrates one single tube and the heat exchange block of the thermosiphon system from FIG. 1 in which a thermally conductive matrix material is contained in an evaporator region of the tube of the thermosiphon system according to some embodiments of the present disclosure.

In FIGS. 3A, 3B, and 4 through 6, the thermally conductive matrix material 38 is illustrated as being contained in the condenser regions 22 of the transport tubes 12. However, as discussed above, the present disclosure is not limited thereto. In this regard, FIG. 7 illustrates an embodiment in which the thermally conductive matrix material 38 is contained in the evaporator region 24 of one of the transport tubes 12. Notably, FIG. 7 only illustrates one of the transport tubes 12 for clarity, but it should be understood that the thermally conductive matrix material 38 may be contained in evaporator region(s) 24 of any one or more of the transport tubes 12. Other than being located in the evaporator region 24, the thermally conductive matrix material 38 is the same as that described above. As such, the details are not repeated.

FIG. 8 illustrates an embodiment in which the thermally conductive matrix material 38 is contained in both the condenser region 22 (illustrated as thermally conductive matrix material 38-1) and the evaporator region 24 (illustrated as thermally conductive matrix material 38-2), but not the adiabatic region 26 of one of the transport tubes 12. Notably, FIG. 8 only illustrates one of the transport tubes 12 for clarity, but it should be understood that the thermally conductive matrix material 38 may be contained in the condenser region 22 and the evaporator region(s) 24 of any one or more of the transport tubes 12.

A thermosiphon system may be augmented to produce the augmented thermosiphon system 10 according to a variety of methods. In this regard, FIG. 9 is a flowchart showing a method for augmenting a thermosiphon system according to some embodiments of the present disclosure. As shown, a method for augmenting a thermosiphon system includes selecting one or more transport tubes of the thermosiphon system to contain a thermally conductive matrix material (step 100). One or more regions for each selected transport tube are predetermined to contain the thermally conductive matrix material (step 102). For example, a condenser region (or a portion(s) thereof) and/or an evaporator region (or a portion(s) thereof) may be predetermined to contain the thermally conductive matrix material. Lastly, the thermally conductive matrix material is inserted into (or formed within) the predetermined portions of the selected transport tubes (step 104).

As discussed above, the thermally conductive matrix material may include a thermally conductive porous material (e.g., a thermally conductive random, semi-random, and/or non-random fiber or powder matrix). In some embodiments, the amount of thermally conductive matrix material and the force used to insert, or pack, the material is determined based on a desired density and/or porosity for the thermally conductive matrix material. In particular, in some embodiments, the magnitude of the packing force influences the porosity of the thermally conductive matrix material that controls the surface area to volume ratio as well as the capillary forces. This is particularly true for thermally conductive matrix materials such as or similar to steel wool or sintered metal. Accordingly, a sufficient amount the thermally conductive matrix material should be packed with a sufficient force to allow for the desired increase in surface area but not so much as to induce excessive capillary forces. Using an excessive packing force for an amount of thermally conductive matrix material would reduce porosity, which increases capillary forces at the portions containing the thermally conductive matrix material. This would reduce heat transport between the condenser region and the evaporator region, which would potentially reduce system level flows of the heat transport medium and reduce heat transport capability overall.

While the disclosure has been described in terms of several embodiments, those skilled in the art will recognize that the disclosure is not limited to the embodiments described above, and can be practiced with modifications and alterations within the spirit and scope of the appended claims.

As an overview, the embodiments detailed above provide mechanisms for mitigating high heat-flux conditions in a thermosiphon evaporator region and/or condenser region.

The disclosed embodiments solve the problem caused when utilizing thermosiphon systems for passive heat transport. In particular, it is often difficult to manage high heat-flux conditions at the evaporator region and/or the condenser region. This problem is often either ignored and the associated losses are absorbed as a cost of using a passive heat transport method or, alternatively, managed with complicated and expensive heat exchangers and manifolds. This becomes even more difficult when dealing with higher pressure refrigerants because the mechanical structure required to safely contain the pressures can swiftly negate the advantages of using an extended surface heat exchanger in the first place due to increasingly large conduction losses through the heat exchanger wall as thicknesses increase.

The disclosed embodiments deal with the issue of managing high heat-flux conditions in the evaporator and/or the condenser of the thermosiphon systems by providing significantly increased surface area to volume ratios inside the standard system transport tube through the addition of a highly thermally conductive matrix material of random or semi-random particles/fibers such as copper, aluminum wool, or sintered powders. This augmentation of material would be located in either the localized evaporator or the localized condenser region of the thermosiphon, but not in the antipodal region (e.g., the adiabatic region) of the system, depending on the desired application for heat absorption or heat rejection.

The disclosed embodiments offer three distinct advantages. First, the additional surface area provided will allow for high efficiency heat transfer from the source (e.g., cooling chamber of a refrigerator) into the thermosiphon working fluid (i.e., the heat transport medium) by providing wetted area sufficient to handle the input power level with very low sensible heat losses or temperature rise/drop.

Second, by isolating the wicking effect of the random/semi-random fiber matrix material to the localized evaporator and/or condenser regions, this can keep intact the thermal diode effect provided by the thermosiphon system and keep thermal leakback to a minimum. Notably, this is a capability that is not possible to provide with full-length wicking structure as seen in traditional heat pipe systems.

Third, the utilization of the same transport tubing already incorporated into the thermosiphon system minimizes additional expenses incurred by the use of extended area heat exchangers. Additionally, in some embodiments, in keeping with simple cylindrical geometry, the system can safely handle very high system pressures with very little modification.

A method of providing extended surface area is the simple packing of a highly conductive random fiber or powder matrix material into the predefined evaporator and/or condenser regions. A mesh density or porosity can be controlled to provide sufficient surface area to volume ratios, to allow for minimal losses with a given heat loading while at the same time minimizing local evaporator region and/or condenser region capillary forces, used to augment local mass and therefore heat transport that could potentially reduce system level mass flows, and heat transport capability.

Another method is to utilize formed screens of highly thermally conductive material that can be stacked in a controlled number to define the density of the fiber medium and to provide both increased surface area to volume ratios but also a low restriction conduit or pathway, provided through geometric design, for supplied or returning working fluid to pass from the transport tubing and associated evaporator or condenser to the high heat-flux region for evaporation or condensation.

Of importance to these embodiments is to provide only locally enhanced surface area to volume ratios without allowing for capillary forces to dominate outside of the predefined region of high heat-flux. This allows the thermosiphon system to retain the full thermal diode capability of an unaugmented thermosiphon system while still allowing for high heat-flux inputs with simplified geometries and materials of construction.

Those skilled in the art will recognize improvements and modifications to the preferred embodiments of the present disclosure. All such improvements and modifications are considered within the scope of the concepts disclosed herein and the claims that follow.

What is claimed is:

1. A thermosiphon system, comprising:

tubing comprising a condenser region, an evaporator region, and a region between the condenser region and the evaporator region, the tubing being operative to contain a heat transport medium and operative to provide passive two-phase transport of the heat transport medium between the condenser region and the evaporator region according to thermosiphon principles as a thermal diode; and a thermally conductive matrix material contained in at least one of the condenser region and the evaporator region of the tubing but not in the region of the tubing between the condenser region and the evaporator region, such that the thermally conductive matrix material provides a porous structure that increases a surface area for heat transfer in the at least one of the condenser region and the evaporator region of the tubing, wherein the thermally conductive matrix material comprises a mesh of a plurality of fibers comprising at least one of randomized diameters, randomized lengths, and randomized spatial orientations, and the mesh comprises a porosity that is predetermined to minimize capillary forces while achieving a predetermined heat transfer rate based on an increased surface area provided by the mesh.

2. The thermosiphon system of claim 1, wherein the thermally conductive matrix material comprises at least one of a random matrix structure and a semi-random matrix structure.

3. The thermosiphon system of claim 1, wherein the thermally conductive matrix material comprises a non-random matrix structure.

4. The thermosiphon system of claim 1, wherein the heat transport medium is a fluid.

5. The thermosiphon system of claim 1, wherein the thermally conductive matrix material is contained in at least one of a portion of the condenser region and a portion of the evaporator region of the tubing.

6. The thermosiphon system of claim 1, wherein the thermally conductive matrix material is contained in at least one of a region coextensive with the condenser region and a region coextensive with the evaporator region of the tubing.

7. The thermosiphon system of claim 1, wherein the mesh is deformable.

8. The thermosiphon system of claim 1, wherein the thermally conductive matrix material has a helical ribbon geometry.

9. The thermosiphon system of claim 1, wherein a thermal conductivity of the thermally conductive matrix material is equal to or greater than a thermal conductivity of the tubing.

10. The thermosiphon system of claim 1, wherein the thermally conductive matrix material is contained in the condenser region.

11. The thermosiphon system of claim 1, wherein the thermally conductive matrix material is contained in the evaporator region.

12. The thermosiphon system of claim 1, wherein the thermally conductive matrix material is contained in the condenser region and contained in the evaporator region.

13. A tubing for a thermosiphon system, comprising:

a thermally conductive matrix material providing a porous structure that increases a surface area for heat transfer in at least one of a condenser region of the tubing and an evaporator region of the tubing but not in a region of the tubing between the condenser region and the evaporator region, where the thermally conductive matrix material comprises a porosity that is predetermined to minimize capillary forces while achieving a predetermined heat transfer rate based on an increased surface area provided by the thermally conductive matrix material, the tubing being operative to contain a heat transport medium and being operative to provide passive two-phase transport of the heat transport medium between the condenser region and the evaporator region according to thermosiphon principles as a thermal diode.

* * * * *